US008888218B2

(12) United States Patent
Matsushita et al.

(10) Patent No.: US 8,888,218 B2
(45) Date of Patent: Nov. 18, 2014

(54) LIQUID EJECTING APPARATUS

(71) Applicant: Seiko Epson Corporation, Tokyo (JP)

(72) Inventors: Junichiro Matsushita, Matsumoto (JP); Hirofumi Teramae, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/971,882

(22) Filed: Aug. 21, 2013

(65) Prior Publication Data

US 2014/0063115 A1 Mar. 6, 2014

(30) Foreign Application Priority Data

Aug. 28, 2012 (JP) ..... 2012-187290

(51) Int. Cl.

| | |
|---|---|
| ***B41J 29/38*** | (2006.01) |
| ***B41J 2/015*** | (2006.01) |
| *B41J 2/165* | (2006.01) |

(52) U.S. Cl.

CPC ..... *B41J 2/165* (2013.01); *B41J 2002/16573* (2013.01); *B41J 2/16526* (2013.01); *B41J 2002/16567* (2013.01)

USPC ..... 347/10; 347/20

(58) Field of Classification Search

CPC ..... B41J 2002/16567

USPC ..... 347/10, 19–20

See application file for complete search history.

(56) References Cited

FOREIGN PATENT DOCUMENTS

JP 2003-039701 2/2003

*Primary Examiner* — Jason Uhlenhake

(74) *Attorney, Agent, or Firm* — Harness, Dickey & Pierce, P.L.C.

(57) ABSTRACT

A liquid ejecting apparatus includes a pressure generation unit that causes a liquid to be ejected from a nozzle opening that communicates with a flow channel and a liquid holding unit that supplies a liquid to the flow channel, and the pressure generation unit performs microvibration driving when the liquid holding unit is replaced.

3 Claims, 5 Drawing Sheets

LIQUID EJECTING APPARATUS

BACKGROUND

1. Technical Field

The present invention relates to liquid ejecting apparatuses including liquid ejecting heads that eject liquid from nozzle openings, and particularly relates to ink jet recording apparatuses that eject ink as a liquid.

2. Related Art

An ink jet recording apparatus including an ink jet recording head that ejects ink droplets from nozzle openings that communicate with flow channels by using pressure generation units to pressurize the flow channels can be given as an example of a liquid ejecting apparatus including a liquid ejecting head that ejects a liquid.

Ink cartridges serving as liquid holding units that hold ink are provided in the ink jet recording head in a removable state, and ink supplied from the ink cartridges is ejected by the ink jet recording head as the ink droplets.

When such an ink jet recording head is left for long periods of time without performing printing operations, the ink near the nozzle openings will dry and cause ejection malfunctions such as the ink droplets traveling in curved paths, clogged nozzle openings, and so on. In addition, when printing operations are not carried out, the flow of ink in the flow channels stops, and a problem will occur where components contained in the ink will sink in the flow channels.

Accordingly, methods such as performing suction operations for sucking the ink in the flow channels from the nozzle openings, performing microvibration driving that vibrates menisci of the ink at the nozzle openings without causing the ink to be ejected as ink droplets, sealing the nozzle openings so as not to make contact with outside air, and so on have been employed (see JP-A-2003-39701).

However, when replacing the liquid holding units such as ink cartridges, a carriage that holds the ink jet recording head is moved from a standby position (a home position) to a replacement position where the replacement can be carried out, and thus the ink jet recording head is released from a cap that covers a liquid ejecting surface. When the liquid ejecting surface of the ink jet recording head is released from the cap in this manner, the ink near the nozzle openings will dry and thicken, causing a problem in that ejection malfunctions such as the ejected ink droplets traveling in curved paths, clogging in the nozzle openings, and so on will occur.

Furthermore, every time when the ink cartridges are replaced, and cleaning operations for sucking ink that has dried and thickened at the nozzle openings from those nozzle openings and discarding the ink are performed, there is a problem in that an increased amount of ink is wastefully consumed.

It should be noted that these problems are not limited to ink jet recording apparatuses including ink jet recording heads, and are also present in other liquid ejecting apparatuses including liquid ejecting heads that eject liquids aside from ink.

SUMMARY

It is an advantage of some aspects of the invention to provide a liquid ejecting apparatus capable of suppressing the wasteful consumption of liquid, as well as suppressing ejection malfunctions caused by drying/thickening of liquid near a nozzle opening, suppressing components from sinking, and so on.

A liquid ejecting apparatus according to an aspect of the invention includes a liquid ejecting head that ejects a liquid from a nozzle opening that communicates with a flow channel by driving a pressure generation unit to cause a change in pressure within the flow channel, a holding member that holds the liquid ejecting head so as to be mobile relative to an ejection target medium, and a liquid holding unit that is held in the holding member and that supplies the liquid to the liquid ejecting head. Here, the pressure generation unit performs microvibration driving when the liquid holding unit is replaced.

According to this aspect, the microvibration driving is performed when the liquid holding unit is replaced, causing a meniscus of the liquid at the nozzle opening to vibrate, which makes it possible to suppress the liquid from drying and thickening near the nozzle opening, suppress components in the liquid in the flow channel from sinking, and so on. Accordingly, it is not necessary to perform cleaning operations that suck the liquid from the nozzle opening after the liquid holding unit has been replaced, which makes it possible to suppress the wasteful consumption of the liquid.

Here, it is preferable for the liquid ejecting apparatus to include a cap that covers a liquid ejecting surface of the liquid ejecting head, and for the pressure generation unit to perform the microvibration driving at a time when the liquid holding unit is replaced and the cap is not on the liquid ejecting head. According to this aspect, the microvibration driving is performed when the liquid ejecting head is not capped, and thus the liquid near the nozzle opening can be prevented from thickening, drying, or the like.

Here, it is preferable for the liquid ejecting head to include a dye nozzle group having a plurality of nozzle openings that eject a dye-based liquid as the liquid and a pigment nozzle group having a plurality of nozzle openings that eject a pigment-based liquid as the liquid, and for the pressure generation units corresponding to the pigment nozzle group to perform the microvibration driving at a time when the liquid holding units are replaced and the cap is not on the liquid ejecting head. According to this aspect, by causing only the pressure generation units corresponding to the pigment nozzle group to perform the microvibration driving, thickening in the pigment-based liquid, which is susceptible to thickening due to drying, can be suppressed, the generation of heat can be suppressed, and the lifespan of the pressure generation units can be extended.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail hereinafter based on an embodiment.

First Embodiment

Figure 1:
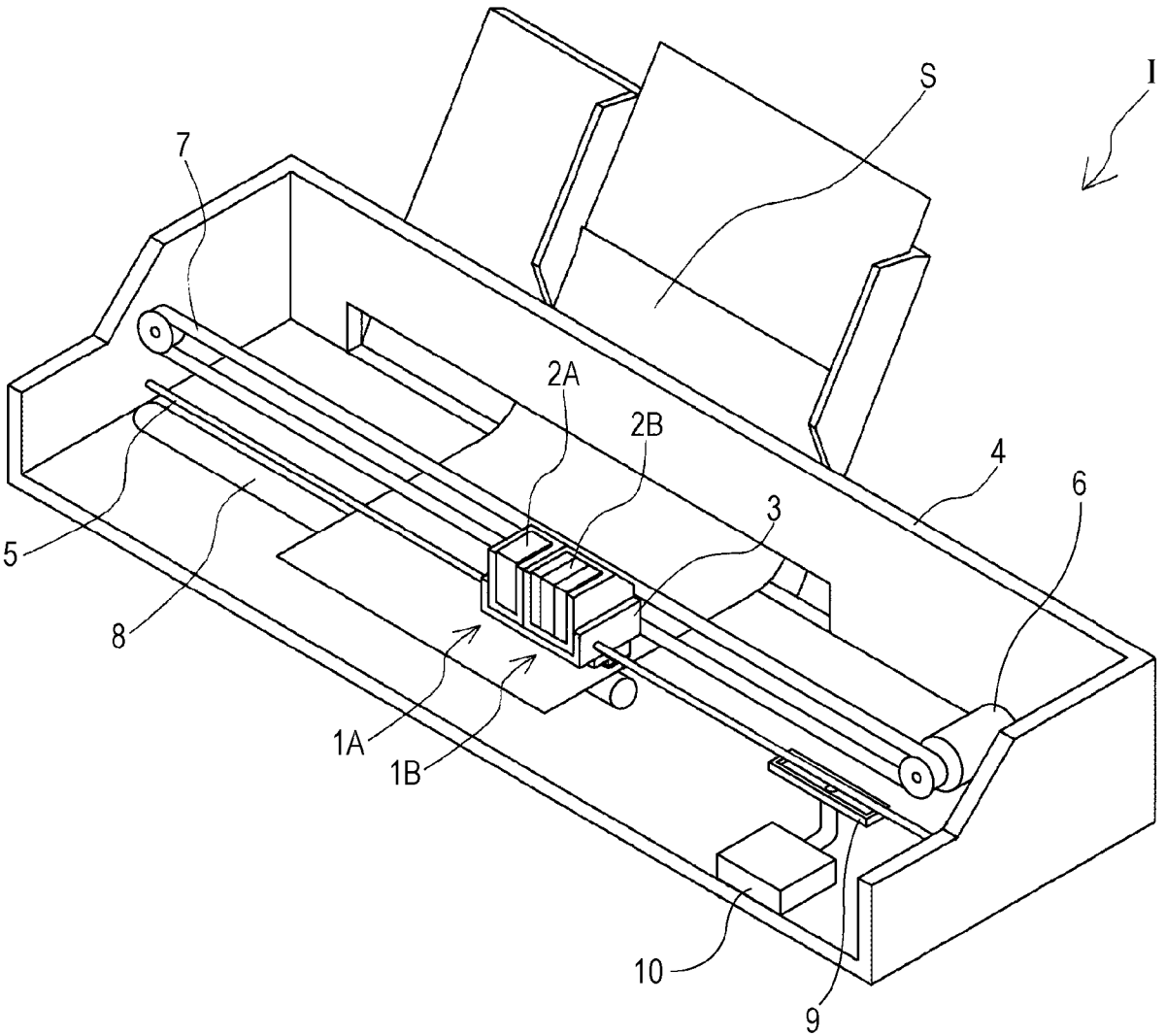
FIG. 1 is a perspective view of a recording apparatus according to a first embodiment of the invention.

FIG. 1 is a schematic diagram illustrating an ink jet recording apparatus serving as an example of a liquid ejecting apparatus according to a first embodiment of the invention.

As shown in FIG. 1, head units 1A and 1B that include ink jet recording heads serving as examples of a liquid ejecting head are respectively provided with ink cartridges 2A and 2B, serving as liquid holding units, in a removable state.

A carriage 3 in which the head units 1A and 1B are mounted is disposed so as to be mobile in the axial direction of a carriage shaft 5 attached to a main apparatus body 4. Note that the head units 1A and 1B each eject black ink compounds and color ink compounds, for example, as liquids.

Transmitting driving force generated by a driving motor 6 to the carriage 3 via a plurality of gears (not shown) and a timing belt 7 moves the carriage 3, in which the head units 1A and 1B are mounted, along the carriage shaft 5 (in a main scanning direction). Meanwhile, a platen 8 is provided in the main apparatus body 4 along the same direction as the carriage shaft 5, and a recording sheet S, serving as a recording medium such as paper supplied by paper supply rollers and the like (not shown), is transported along on the platen 8 (in a sub scanning direction). With such an ink jet recording apparatus I, printing onto the recording sheet S is carried out by the carriage 3 moving along the carriage shaft 5 while ink droplets are ejected by the ink jet recording head.

In addition, a suction cap 9, serving as a cap according to this embodiment, that covers the nozzle openings is provided in a non-printing region of the ink jet recording apparatus I according to this embodiment. The "non-printing region" according to this embodiment is located to the side of the platen 8, at an end in the movement direction of the carriage 3. The suction cap 9 is connected via a tube to, for example, a suction device 10 such as a vacuum pump or the like. By using the suction device 10 to suck the air from the interior of the suction cap 9 that has been fitted tightly against the liquid ejecting surface of the ink jet recording head, the ink in the flow channels of the ink jet recording head is sucked through the nozzle openings. Note that the suction cap 9 also functions as a sealing cap that suppresses the ink near the nozzle openings from drying and thickening by being tightly fitted against the liquid ejecting surface of the ink jet recording head and sealing the nozzle openings when printing is not being carried out. Of course, a separate sealing cap may be provided in addition to the suction cap 9. The cap according to the scope of the aspects in this application is not particularly limited as long as the cap covers the nozzle openings and suppresses the ink near the nozzle openings from drying and thickening, and the cap may be the suction cap 9 according to this embodiment, a sealing cap, or another type of cap.

Note that in this embodiment, the region where the suction cap 9 is provided is referred to as the home position of the ink jet recording head (carriage 3).

Figure 2:
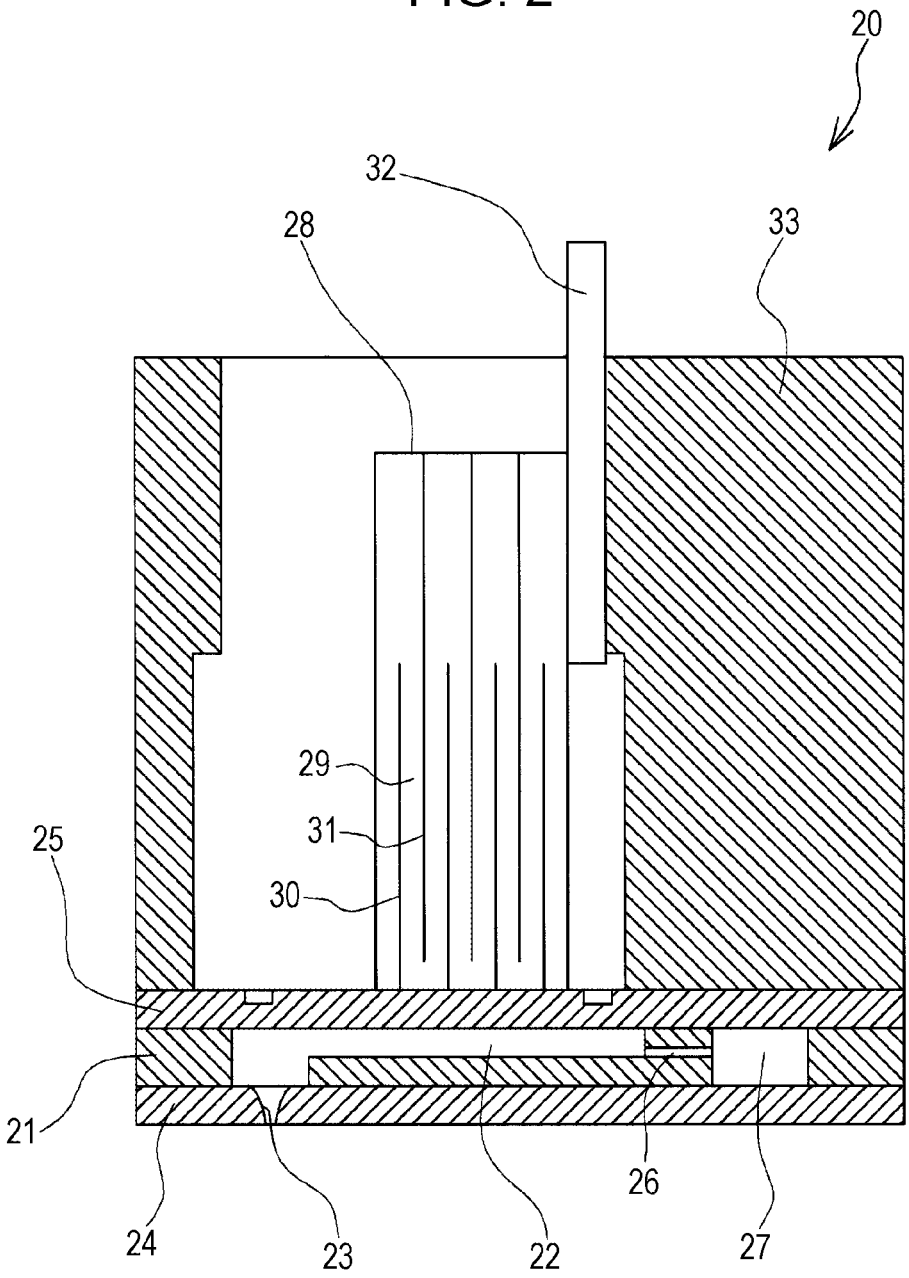
FIG. 2 is a cross-sectional view of a recording head according to the first embodiment of the invention.

Here, the ink jet recording head, serving as an example of a liquid ejecting head, will be described using FIG. 2. FIG. 2 is a cross-sectional view of the ink jet recording head serving as an example of the liquid ejecting head.

An ink jet recording head 20 shown in FIG. 2 is a type that includes longitudinally-vibrating piezoelectric actuators; a plurality of pressure generation chambers 22 are arranged in a flow channel substrate 21, following a direction in which a plurality of nozzle openings 23 that eject the same color ink are arranged. Hereinafter, this direction will be referred to as an "arrangement direction of the pressure generation chambers 22" or a "first direction". Both sides of the flow channel substrate 21 (that is, a surface in which the pressure generation chambers 22 are provided, and the surface on the opposite side thereof) are sealed by a nozzle plate 24 having the nozzle openings 23 that correspond to the respective pressure generation chambers 22, and by a vibration plate 25. In addition, a manifold 27 that serves as a common ink chamber for the plurality of pressure generation chambers 22 by communicating with each pressure generation chamber 22 via respective ink supply openings 26 is formed in the flow channel substrate 21, and the ink cartridges 2A and 2B illustrated in FIG. 1 are connected to the manifold 27.

Meanwhile, piezoelectric actuators 28 are provided in the vibration plate 25 on the side opposite to the pressure generation chambers 22, with leading ends of each piezoelectric actuator 28 making contact with a region corresponding to a respective pressure generation chamber 22. These piezoelectric actuators 28 are configured by layering a piezoelectric material 29 vertically between alternating layers of electrode-forming materials 30 and 31 in a sandwich-like shape, and a non-active region that does not contribute to vibrations is anchored to an anchor plate 32. Note that the anchor plate 32, the vibration plate 25, the flow channel substrate 21, and the nozzle plate 24 are anchored to a base section 33 as a single unit.

In the ink jet recording head 20 configured in this manner, ink is supplied to the manifold 27 via ink flow channels that communicate with the ink cartridges 2A and 2B, and the ink is then distributed to the pressure generation chambers 22 via the corresponding ink supply openings 26. In actuality, the piezoelectric actuators 28 contract when a voltage is applied to the piezoelectric actuators 28. As a result, the vibration plate 25 deforms along with the piezoelectric actuators 28 (in FIG. 2, retracts in the upward direction), causing the capacity of the pressure generation chambers 22 to increase, thereby pulling ink into the pressure generation chambers 22. After ink has filled the chambers up to the nozzle openings 23, the voltage applied to the electrode-forming materials 30 and 31 of the piezoelectric actuators 28 is canceled based on a recording signal from a driving circuit, causing the piezoelectric actuators 28 to extend and return to their original states. Through this, the vibration plate 25 is also displaced and returns to its original state, causing the pressure generation chambers 22 to contract, increasing the internal pressure thereof and discharging ink droplets from the nozzle openings 23 as a result. In other words, in this embodiment, longitudinally-vibrating piezoelectric actuators 28 are provided as pressure generation units causing a change in the pressure in the pressure generation chambers 22. In this embodiment, the surface in which the nozzle openings 23 are provided corresponds to the liquid ejecting surface.

Figure 3:
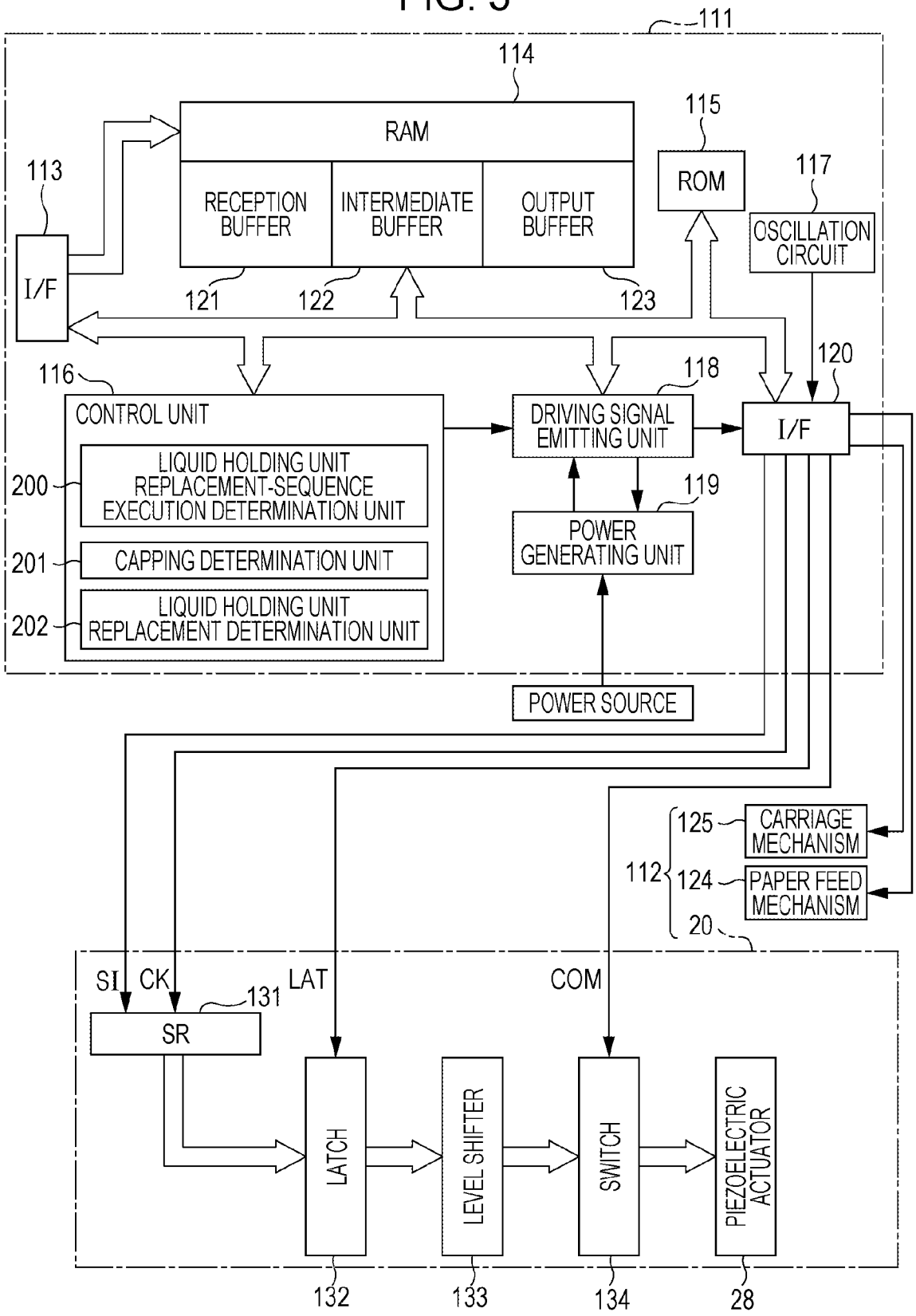
FIG. 3 is a block diagram illustrating a configuration for carrying out control according to the first embodiment of the invention.

Here, control of the ink jet recording apparatus I according to this embodiment will be described with reference to FIG. 3. FIG. 3 is a block diagram illustrating a configuration for carrying out control of the ink jet recording apparatus according to the first embodiment of the invention.

As shown in FIG. 3, the ink jet recording apparatus I according to this embodiment is generally configured of a printer controller 111 and a print engine 112. The printer controller 111 includes: an external interface 113 (referred to as an "external I/F 113" hereinafter); a RAM 114 that temporarily stores various types of data; a ROM 115 that stores control programs and the like; a control unit 116 configured including a CPU and the like; an oscillation circuit 117 that emits a clock signal; a driving signal emitting unit 118 that emits a driving signal to be supplied to the ink jet recording head 20; a power generating unit 119 that generates power used by the driving signal emitting unit 118; and an internal interface 120 (referred to as an "internal I/F 120" hereinafter)

that sends dot pattern data (bitmap data) and the like rendered based on driving signals and print data to the print engine 112.

The external I/F 113 receives, from a host computer or the like (not shown), print data configured of, for example, character codes, graphic functions, image data, and the like. A busy signal (BUSY), an acknowledge signal (ACK), and the like are outputted to the host computer or the like through the external I/F 113. The RAM 114 functions as a reception buffer 121, an intermediate buffer 122, an output buffer 123, and a work memory (not shown). The reception buffer 121 temporarily stores print data received by the external I/F 113, the intermediate buffer 122 stores intermediate code data obtained through conversion performed by the control unit 116, and the output buffer 123 stores dot pattern data. This dot pattern data is configured of printing data obtained by decoding (translating) gradation data.

The driving signal emitting unit 118 corresponds to a driving signal emitting unit according to the invention, and emits an ejection driving signal, a microvibration driving signal, and the like.

Although details will be given later, the ejection driving signal (COM) is a signal containing an ejection pulse that drives the piezoelectric actuator 28 so as to eject an ink droplet (ejection driving) in a single recording cycle T, and is repeatedly emitted every recording cycle T.

Furthermore, although details will be given later, the microvibration driving signal is a signal containing a microvibration driving pulse that drives the piezoelectric actuator 28 to an extent that does not cause an ink droplet to be ejected (microvibration driving) in a cycle T', and is repeatedly emitted every cycle T'.

Note that a signal that combines the ejection pulse and the microvibration driving pulse may be used as the driving signal, and the ejection pulse, the microvibration driving pulse, or both may then be supplied to the piezoelectric actuators at a predetermined timing.

Incidentally, the recording cycle T is a unit of repetition of the ejection driving signal, and is a type of ejection cycle according to the invention. In addition, the cycle T' is a unit of repetition of microvibration driving, and can be set to any desired cycle. Of course, a plurality of different voltages, times, cycles, and so on may be prepared for microvibration driving pulses in the microvibration driving, and the microvibration driving pulse may then be selected as necessary. Furthermore, the microvibration driving includes in-printing microvibration that suppresses unused nozzle openings from clogging by causing microvibrations in the piezoelectric actuators 28 that do not eject ink during printing, and non-printing microvibration that causes microvibrations in the piezoelectric actuators 28 outside of the range in which the in-printing microvibration is carried out. The in-printing microvibration and the non-printing microvibration may employ the same microvibration driving signal, or a dedicated microvibration driving signal may be used for the non-printing microvibration. Although details will be given later, a microvibration driving signal illustrated in FIG. 4B of this embodiment is a dedicated non-printing microvibration driving signal.

Meanwhile, font data, graphic functions, and the like are stored in the ROM 115 in addition to control programs (control routines) for executing various types of data processes.

The control unit 116 reads out print data from the reception buffer 121 and stores intermediate code data obtained by converting this print data in the intermediate buffer 122. The intermediate code data read out from the intermediate buffer 122 is analyzed, and the intermediate code data is rendered as dot pattern data by referring to the font data, graphic functions, and so on stored in the ROM 115. The control unit 116 then performs necessary embellishment processes and stores the rendered dot pattern data in the output buffer 123.

When dot pattern data corresponding to one line of the ink jet recording head 20 has been obtained, that one line's worth of dot pattern data is outputted to the ink jet recording head 20 through the internal I/F 120. Furthermore, when one line's worth of dot pattern data has been outputted from the output buffer 123, the rendered intermediate code data is deleted from the intermediate buffer 122 and a process for rendering the next intermediate code data is carried out.

The control unit 116 causes the piezoelectric actuators 28 of the ink jet recording head 20 to perform microvibration driving at a predetermined timing.

Specifically, the control unit 116 includes a liquid holding unit replacement-sequence execution determination unit 200, a capping determination unit 201, and a liquid holding unit replacement determination unit 202. Note that "capping" as mentioned in this embodiment refers to the suction cap 9 covering at least the nozzle openings 23.

The liquid holding unit replacement-sequence execution determination unit 200 determines whether or not a replacement-sequence for the ink cartridges 2A and 2B (see FIG. 1) that serve as liquid holding units has been executed. Here, the "liquid holding unit replacement-sequence" refers to executing, in order, procedures for replacing the ink cartridges 2A and 2B that serve as the liquid holding units. For example, the liquid holding unit replacement-sequence exposes the liquid ejecting surface from a state in which the liquid ejecting surface is capped by the suction cap 9 at the home position (the non-printing region), and moves the carriage 3 in a scanning direction to a predetermined replacement position. The ink cartridges 2A and 2B that require replacement are then indicated visually, auditorily, or the like. When the ink cartridges 2A and 2B have then been replaced by a user, the carriage 3 moves to the home position (the non-printing region), and the liquid ejecting surface is capped by the suction cap 9. Processes such as resetting a remaining ink amount count for the ink cartridges 2A and 2B are also performed.

This liquid holding unit replacement-sequence is executed, for example, when a replacement switch is depressed by the user. Note that it is the user who actually replaces the ink cartridges 2A and 2B during the liquid holding unit replacement-sequence. Accordingly, the ink jet recording head 20 (carriage 3) remains in the replacement position as long as the user does not carry out the replacement. Of course, the ink jet recording head 20 (carriage 3) may be moved to the home position and the liquid ejecting surface may be capped by the suction cap 9 in the case where the user has not replaced the ink cartridges 2A and 2B even after a set amount of time has elapsed.

Incidentally, the ink cartridges 2A and 2B cannot be replaced from the home position (the non-printing region). This is because, for example, a power source and the like are provided at the home position (the non-printing region), and there is thus a risk that the user will experience an electric shock or the like. Furthermore, if the user is able to replace the ink cartridges 2A and 2B at the home position (the non-printing region), there is a risk that the ink cartridges 2A and 2B will be replaced while the ink jet recording apparatus I is turned off. If the ink cartridges 2A and 2B are replaced while the ink jet recording apparatus I is turned off in this manner, there is a risk that the remaining ink amount in the ink cartridges 2A and 2B cannot be accurately obtained, a risk that the wrong color ink cartridge will be installed, and so on. In the liquid holding unit replacement-sequence according to this embodiment, moving the carriage 3 to the replacement position, and more specifically, moving the carriage 3 to a printing region or the like and enabling the ink cartridges 2A and 2B to be replaced makes it possible to reduce the risk of electric shocks, and enables the ink jet recording apparatus I to be turned on and detect the replacement of the ink cartridges 2A and 2B; this makes it possible to accurately detect the pre-replacement and post-replacement states of the ink cartridges 2A and 2B.

The capping determination unit 201 determines whether or not the liquid ejecting surface of the ink jet recording head 20 is capped by the suction cap 9. For example, a sensor may be provided in the suction cap 9, and whether or not the suction cap 9 is making contact with the liquid ejecting surface may be determined; alternatively, whether the suction cap 9 is making contact with the liquid ejecting surface may be determined based on a state of control for moving the suction cap 9 toward the liquid ejecting surface.

The liquid holding unit replacement determination unit 202 determines whether or not the ink cartridges 2A and 2B that serve as the liquid holding units have been replaced. For example, sensors may be provided in areas where the ink cartridges 2A and 2B are mounted, and whether or not the ink cartridges 2A and 2B have been replaced may be determined by monitoring whether the ink cartridges 2A and 2B are mounted/removed; alternatively, memories in which information of the ink cartridges 2A and 2B (ink information, IDs, or the like) is recorded may be provided in the ink cartridges 2A and 2B, and whether or not the ink cartridges 2A and 2B have been replaced may be determined by reading the information of the ink cartridges 2A and 2B from those memories.

The print engine 112 is configured including the ink jet recording head 20, a paper feed mechanism 124, and a carriage mechanism 125. The paper feed mechanism 124 is configured of a paper feed motor, the platen 8, and so on, and sequentially feeds out the recording sheet S, such as recording paper, as the ink jet recording head 20 carries out recording operations. In other words, the paper feed mechanism 124 moves the recording sheet S relatively in the sub scanning direction.

The carriage mechanism 125 is configured of the carriage 3 in which the ink jet recording head 20 can be mounted and a carriage driving unit that causes the carriage 3 to make scans in the main scanning direction, and moves the ink jet recording head 20 in the main scanning direction by causing the carriage 3 to make scans. Note that the carriage driving unit is configured of the driving motor 6, the timing belt 7, and so on as described above.

The ink jet recording head 20 includes the multiple nozzle openings 23 provided along the sub scanning direction, and ejects ink droplets from the respective nozzle openings 23 at timings defined by the dot pattern data and the like. Electrical signals such as the ejection driving signal (COM), the microvibration driving signal, printing data (SI), and so on are supplied to the piezoelectric actuators 28 of the ink jet recording head 20 via external wires (not shown). Note that with the printer controller 111 and the print engine 112 being configured in this manner, a driving unit that applies a predetermined driving signal to the piezoelectric actuators 28 is configured of the printer controller 111 and a driving circuit including a shift register 131, a latch 132, a level shifter 133, a switch 134, and so on that selectively input, to the piezoelectric actuators 28, driving signals having predetermined driving waveforms outputted from the driving signal emitting unit 118. Incidentally, the shift register 131, the latch 132, the level shifter 133, the switch 134, and the piezoelectric actuator 28 are provided for each of the nozzle openings 23 in the ink jet recording head 20, and the shift register 131, the latch 132, the level shifter 133, and the switch 134 generate driving pulses from the ejection driving signals, the microvibration driving signals, and so on emitted from the driving signal emitting unit 118. Here, "driving pulses" refers to applied pulses that are actually applied to the piezoelectric actuators 28.

With this ink jet recording head 20, the printing data (SI) that configures the dot pattern data first is serially transferred from the output buffer 123 to the shift register 131 in synchronization with the clock signal (CK) from the oscillation circuit 117, and is sequentially set. In this case, first, data of the most significant bit in the printing data for all the nozzle openings 23 is serially transferred, and once the serial transfer of the data of the most significant bit is complete, data of the next most significant bit is serially transferred. Data of the less significant bits is serially transferred in order in the same manner thereafter.

When the printing data of those bits has been set in the respective shift registers 131 for all of the nozzles, the control unit 116 controls to output a latch signal (LAT) to the latch 132 at a predetermined timing. With this latch signal, the latch 132 latches the printing data that has been set in the shift register 131. The printing data that has been latched by the latch 132 (LATout) is applied to the level shifter 133; the level shifter 133 is a voltage amplifier. In the case where the printing data is, for example, "1", the level shifter 133 boosts the printing data to a voltage value that can drive the switch 134, such as several tens of volts. The boosted printing data is then applied to the respective switches 134, and each switch 134 enters a connected state as a result of the printing data.

The ejection driving signal emitted by the driving signal emitting unit 118 is also applied to each switch 134, and when the switch 134 selectively enters the connected state, a driving signal is selectively applied to the piezoelectric actuator 28 connected to the switch 134. In this manner, according to the ink jet recording head 20 described as an example here, it is possible to control whether or not to apply the ejection driving signal to the piezoelectric actuator 28 based on the printing data. For example, during a period where the printing data is "1", the switch 134 enters the connected state due to the latch signal (LAT); as a result, a driving signal (COMout) can be supplied to the piezoelectric actuator 28, and the piezoelectric actuator 28 displaces (deforms) under the supplied driving signal (COMout). Meanwhile, during a period where the printing data is "0", the switch 134 enters a disconnected state, and thus the supply of the driving signal to the piezoelectric actuator 28 is interrupted. Note that each piezoelectric actuator 28 holds the most recent potential during periods where the printing data is "0", and thus the most recent state of displacement in the piezoelectric actuator 28 is maintained.

The aforementioned piezoelectric actuator 28 is what is known as a longitudinally-vibrating piezoelectric actuator 28. When a longitudinally-vibrating piezoelectric actuator 28 is used, the piezoelectric actuator 28 contracts in a direction orthogonal to an electrical field upon being charged, causing the corresponding pressure generation chamber 22 to expand; when the charged piezoelectric actuator 28 is discharged, the piezoelectric actuator 28 extends and the pressure generation chamber 22 contracts. According to this ink jet recording head 20, the volume of the pressure generation chamber 22 changes in correspondence with the charging/discharging of the piezoelectric actuator 28, and thus liquid droplets can be ejected from the nozzle openings 23 by using pressure changes in the pressure generation chambers 22.

Next, the ejection driving signal COM and the microvibration driving signal emitted by the driving signal emitting unit 118, and control for supplying these driving signals to the piezoelectric actuator 28, will be described. Note that FIGS. 4A and 4B are diagrams illustrating driving waveforms of the driving signals.

Figure 4A:
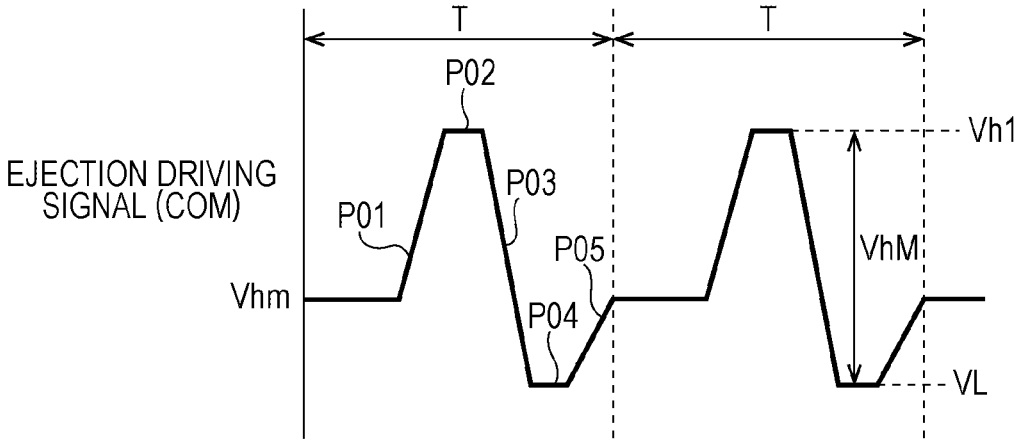
FIGS. 4A and 4B are waveform diagrams illustrating driving waveforms according to the first embodiment of the invention.

As shown in FIG. 4A, the ejection driving signal (COM) contains an ejection pulse emitted every recording cycle T. The ejection pulse contains a first expansion element P01 that causes the pressure generation chamber 22 to expand by increasing a potential from a state in which an intermediate potential Vhm is held to a first expansion potential Vh1, a first holding element P02 that holds the first expansion potential Vh1 for a set amount of time, a first contraction element P03 that causes the pressure generation chamber 22 to contract by reducing the potential from the first expansion potential Vh1 to a first contraction potential VL at a sharp slope, a second holding element P04 that holds the first contraction potential VL for a set amount of time, and a first damping element P05 that restores the potential from the first contraction potential VL to the intermediate potential Vhm at a constant slope that does not cause ink droplets to be ejected.

When this ejection driving signal COM is supplied to the piezoelectric actuator 28, the piezoelectric actuator 28 deforms in a direction that causes the volume of the pressure generation chamber 22 to expand as a result of the first expansion element P01, the meniscus within the nozzle opening 23 is pulled back toward the pressure generation chamber 22, and ink is supplied to the pressure generation chamber 22 from the manifold 27. This expanded state of the pressure generation chamber 22 is maintained by the first holding element P02. After this, the first contraction element P03 is supplied, extending the piezoelectric actuator 28. As a result, the pressure generation chamber 22 contracts suddenly from the expanded volume to a contracted volume that corresponds to the first contraction potential VL, the ink in the pressure generation chamber 22 is pressurized, and an ink droplet is ejected from the nozzle opening 23. The contracted state of the pressure generation chamber 22 is maintained by the second holding element P04, and during this period, the pressure of the ink in the pressure generation chamber 22 that has decreased due to the ink droplet being ejected once again rises due to the natural vibration. The first damping element P05 is supplied in correspondence with the timing of this rise, the pressure generation chamber 22 returns to its standard volume, and changes in the pressure in the pressure generation chamber 22 are absorbed. In other words, the ejection pulse generated by the ejection generation signal COM according to this embodiment is a pull-push type.

Figure 4B:
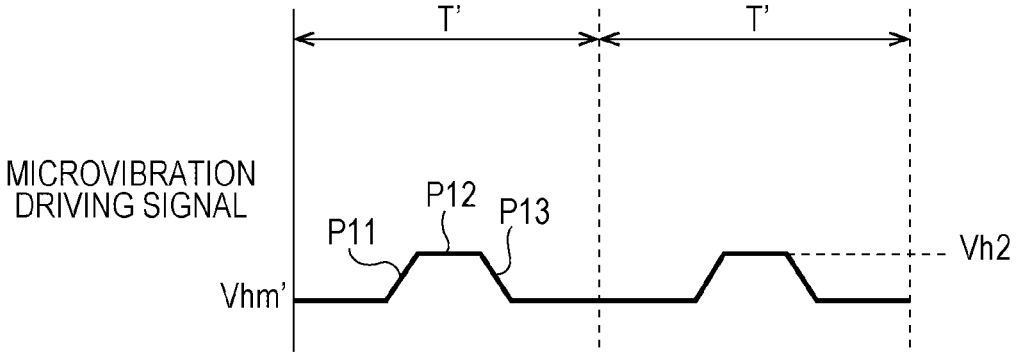

As shown in FIG. 4B, the microvibration driving signal functions as a non-ejection driving signal that drives the piezoelectric actuator 28 to a degree where an ink droplet is not ejected from the nozzle opening 23, and includes the microvibration driving pulse (non-ejection pulse) that occurs every cycle T'. In this embodiment, the microvibration driving pulse (non-ejection pulse) is a trapezoidal wave in which a voltage of a magnitude that does not cause an ink droplet to be ejected from the nozzle opening 23 is applied to the piezoelectric actuator 28. Of course, the microvibration driving pulse is not limited to a trapezoidal wave; a pulse that reduces the driving voltage of the ejection pulse (that is, a potential difference from a minimum potential to a maximum potential) to a magnitude at which an ink droplet is not ejected from the nozzle opening 23, or in other words, a shape obtained by reducing the ejection pulse in the vertical direction (an axial direction of the voltage change), may be employed as the microvibration driving pulse, and the shape thereof is not particularly limited.

Specifically, the microvibration driving pulse contains a second expansion element P11 that causes the pressure generation chamber 22 to expand by raising a potential from an intermediate potential Vhm' to a second expansion potential Vh2, a third holding element P12 that holds the second expansion potential Vh2, and a second contraction element P13 that causes the pressure generation chamber 22 to contract by reducing the potential from the second expansion potential Vh2 to the intermediate potential Vhm'.

With this microvibration driving pulse, the second expansion potential Vh2 and the slopes of the second expansion element P11 and the second contraction element P13 (that is, an amount of change in the potential per unit time) are set so that an ink droplet will not be ejected from the nozzle opening 23.

The ejection pulse in the ejection driving signal described above is supplied to the piezoelectric actuators 28 corresponding to the nozzle openings 23 from which ink droplets are to be ejected when printing is executed. Meanwhile, the microvibration driving pulse in the microvibration driving signal is supplied to the piezoelectric actuators 28 corresponding to the nozzle openings 23 that are to eject ink droplets at a predetermined timing, such as prior to when the ink droplets are to be ejected, an interval between ink droplet ejections, and so on. The microvibration driving pulse is supplied to the piezoelectric actuators 28 corresponding to the nozzle openings 23 from which ink droplets are not ejected when printing is executed. Furthermore, in this embodiment, the microvibration driving pulse is supplied to the piezoelectric actuators 28 when the liquid holding unit replacement-sequence is being executed, or when the liquid holding unit replacement-sequence is being executed and the liquid ejecting surface is not capped by the suction cap 9.

The timing at which the microvibration driving pulse is supplied will now be described with reference to FIGS. 3 and 5. Note that FIG. 5 illustrates a flow of control for supplying the microvibration driving pulse.

Figure 5:
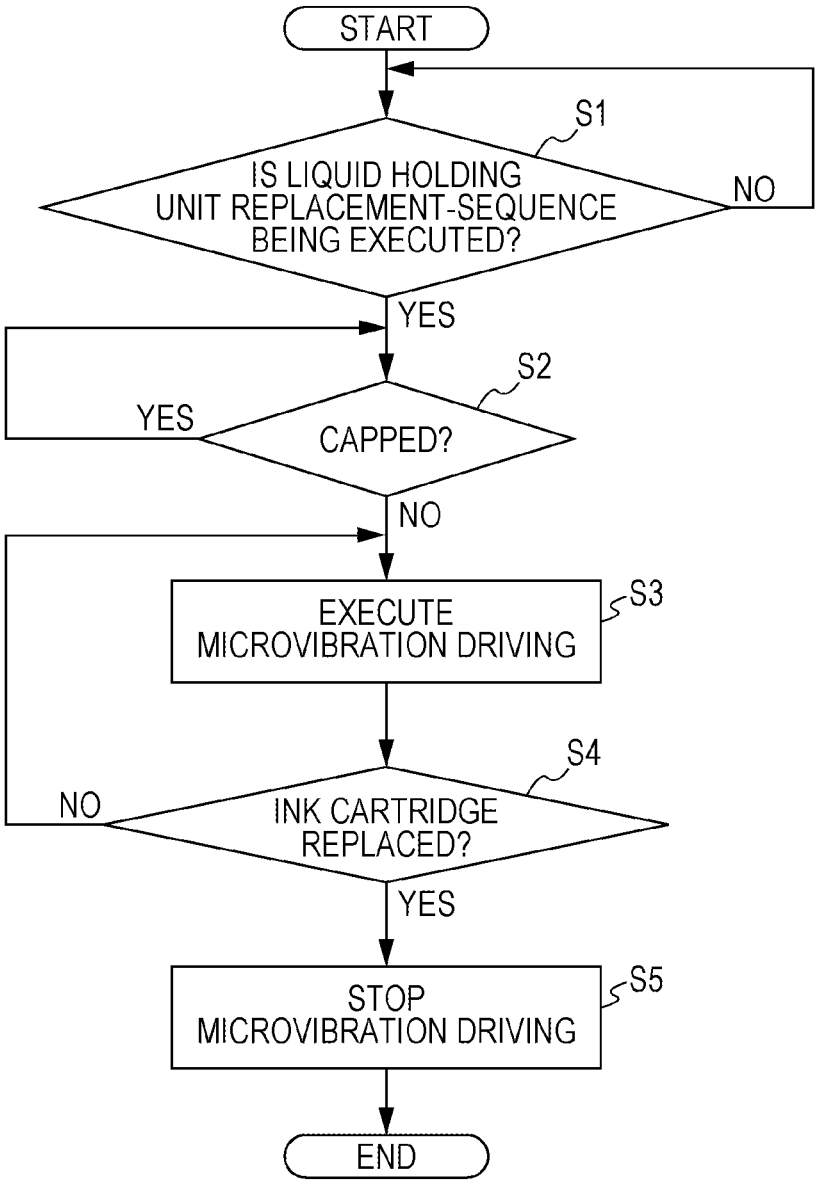
FIG. 5 is a flowchart illustrating a microvibration driving process according to the first embodiment of the invention.

As shown in FIG. 5, in step S1, the liquid holding unit replacement-sequence execution determination unit 200 determines whether or not the liquid holding unit replacement-sequence is being executed, and in the case where it is determined that the replacement-sequence is being executed (step S1: Yes), the capping determination unit 201 determines in step S2 whether or not the liquid ejecting surface is capped by the suction cap 9. In the case where the capping determination unit 201 has determined in step S2 that the liquid ejecting surface is not capped by the suction cap 9 (step S2: No), the nozzle openings 23 are exposed and the ink near the nozzle openings 23 will dry and thicken; therefore, in step S3, the control unit 116 causes the piezoelectric actuators 28 to perform microvibration driving. Through this, the ink menisci in the exposed nozzle openings 23 vibrate, the ink near the nozzle openings 23 is agitated, and the ink near the nozzle openings 23 is suppressed from drying and thickening as a result.

Next, in step S4, the liquid holding unit replacement determination unit 202 determines whether or not the ink cartridges 2A and 2B (see FIG. 1) have been replaced, and in the case where the liquid holding unit replacement determination unit 202 has determined that the ink cartridges 2A and 2B have been replaced (step S4: Yes), in step S5, the control unit 116 stops the microvibration driving of the piezoelectric actuators 28. On the other hand, in the case where the liquid holding unit replacement determination unit 202 has determined in step S4 that the ink cartridges 2A and 2B have not been replaced (step S4: No), the procedure returns to step S3 and the microvibration driving of the piezoelectric actuators 28 is continued.

Note that in the case where the liquid holding unit replacement-sequence execution determination unit 200 has determined in step S1 that the liquid holding unit replacement-sequence is not being executed (step S1: No), the capping determination unit 201 is made to stand by until the liquid holding unit replacement-sequence is executed (a loop process). Incidentally, the liquid holding unit replacement-sequence is executed when, for example, the user depresses a replacement button, as described above.

Meanwhile, in the case where the capping determination unit 201 has determined in step S2 that the liquid ejecting surface is capped by the suction cap 9 (step S2: Yes), the microvibration driving is made to stand by until the liquid ejecting surface is no longer capped (a loop process).

Although this embodiment describes providing the liquid holding unit replacement determination unit 202 in the control unit 116 and the control unit 116 causing the piezoelectric actuators 28 to perform microvibration driving until the liquid holding unit replacement determination unit 202 has determined in step S4 that the ink cartridges 2A and 2B have been replaced, it should be noted that the ink jet recording head 20 is normally moved to the home position and faces the suction cap 9 immediately after the ink cartridges 2A and 2B have been replaced; as a result, the liquid ejecting surface is covered by the suction cap 9, and the amount of time for which the nozzle openings 23 are exposed is short. Accordingly, almost no drying/thickening occurs in the ink near the nozzle openings 23 in the short amount of time from when the ink cartridges 2A and 2B are replaced to when the liquid ejecting surface is capped by the suction cap 9, and thus the microvibration driving need not be carried out during this short amount of time. Of course, the control unit 116 may cause the piezoelectric actuators 28 to perform the microvibration driving until the liquid ejecting surface is capped by the suction cap 9 even in the case where the liquid holding unit replacement determination unit 202 has determined that the ink cartridges 2A and 2B have just been replaced.

In this manner, according to this embodiment, when the ink cartridges 2A and 2B serving as liquid holding units that supply ink to the ink jet recording head 20 are replaced, the menisci of the ink at the nozzle openings 23 can be vibrated and the ink near the nozzle openings 23 can be agitated by causing the piezoelectric actuators 28 to perform microvibration driving during the period when the liquid ejecting surface is not capped by the suction cap 9. Accordingly, the ink near the nozzle openings 23 can be suppressed from drying and thickening, which in turn makes it possible to reduce ejection malfunctions such as the ejected ink droplets traveling in curved paths, the nozzle openings becoming clogged, and so on due to thickening in the ink near the nozzle openings 23; furthermore, it is possible to prevent components of the ink from sinking as well.

In addition, it is not necessary to perform cleaning operations for sucking and discarding thickened ink from the nozzle openings 23 using the suction cap 9 and the suction device 10 when replacing the ink cartridges 2A and 2B, which makes it possible to suppress the wasteful consumption of ink.

Other Embodiments

Although an embodiment of the invention has been described thus far, the basic configuration of the invention is not intended to be limited to the aforementioned descriptions.

For example, although the aforementioned first embodiment describes the control unit 116 causing all of the piezoelectric actuators 28 in the ink jet recording head 20 to perform microvibration driving at a predetermined timing, the invention is not particularly limited thereto. For example, in the case where the ink jet recording head 20 or the ink jet recording head units 1A and 1B include a pigment nozzle group having a plurality of nozzle openings that eject a pigment-based ink and a dye nozzle group having a plurality of nozzle openings that eject a dye-based ink, the control unit 116 may selectively cause only the piezoelectric actuators 28 that correspond to the pigment nozzle group to perform microvibration driving in the case where the liquid holding unit replacement-sequence execution determination unit 200 has determined that the replacement-sequence is being executed and the capping determination unit 201 has determined that the liquid ejecting surface is not capped. Through this, particularly when replacing the ink cartridges 2A and 2B whose nozzle openings 23 that eject a pigment-based ink, which is particularly susceptible to drying and thickening, are not covered by the suction cap 9, it is possible to suppress the drying and thickening of the pigment-based ink, suppress components in the pigment-based ink from sinking, and so on; furthermore, by refraining from causing the piezoelectric actuators 28 that correspond to the dye nozzle group to perform microvibration driving, it is possible to suppress heat from being generated due to the piezoelectric actuators 28 being driven. Furthermore, by refraining from driving the piezoelectric actuators 28 corresponding to the nozzle openings 23 that eject the dye-based ink, the lifespan of the piezoelectric actuators 28 can be extended.

Furthermore, although the aforementioned first embodiment describes using, as the pressure generation units that instigate a change in pressure in the pressure generation chambers 22, the longitudinally-vibrating piezoelectric actuators 28 that are configured by layering a piezoelectric material and electrode-forming materials in alternation with each other and that extend/contract in an axial direction, the pressure generation units are not limited thereto; laterally-vibrating piezoelectric actuators that are configured by layering the piezoelectric material 29 and the electrode-forming materials 30 and 31 in alternation with each other and causing one end thereof in the direction of the layers to make contact with the vibration plate 25 may be used instead. In addition, a flexural mode piezoelectric actuator, such as a thin-film piezoelectric actuator in which electrodes and a piezoelectric material are formed through deposition and lithography, a thick-film piezoelectric actuator formed through a method such as applying a green sheet, and so on can be employed as well. Moreover, a device in which heating elements are disposed within the pressure generation chambers and liquid droplets are ejected from the nozzle openings due to bubbles forming as a result of the heat from the heating elements, a so-called electrostatic actuator that generates static electricity between a vibrating plate and an electrode, with the resulting static electricity force causing the vibrating plate to deform and liquid droplets to be ejected from the nozzle openings, can also be used as the pressure generation units.

Furthermore, the invention is generally applicable in all liquid ejecting apparatuses that include a liquid ejecting head, and can be applied in liquid ejecting apparatuses that include, for example, recording heads such as various types of ink jet recording heads used in image recording apparatuses such as printers, color material ejecting heads used in the manufacture of color filters for liquid-crystal displays and the like, electrode material ejecting heads used to form electrodes for organic EL displays, FEDs (field emission displays), and the like, bioorganic matter ejecting heads used in the manufacture of biochips, and so on.

The entire disclosure of Japanese Patent Application No. 2012-187290, filed Aug. 28, 2012 is expressly incorporated by reference herein.

What is claimed is:

1. A liquid ejecting apparatus comprising:

a liquid ejecting head that ejects a liquid from a nozzle opening that communicates with a flow channel by driving a pressure generation unit to cause a change in pressure within the flow channel;

a holding member that holds the liquid ejecting head so as to be mobile relative to an ejection target medium; and a liquid holding unit that is held in the holding member and that supplies the liquid to the liquid ejecting head, wherein the pressure generation unit performs microvibration driving immediately after the liquid holding unit is replaced.

2. The liquid ejecting apparatus according to claim 1, further comprising:

a cap that covers a liquid ejecting surface of the liquid ejecting head, wherein the pressure generation unit performs the microvibration driving while the cap is not on the liquid ejecting head.

3. The liquid ejecting apparatus according to claim 2, wherein the liquid ejecting head includes a dye nozzle group having a plurality of nozzle openings that eject a dye-based liquid as the liquid and a pigment nozzle group having a plurality of nozzle openings that eject a pigment-based liquid as the liquid, and the pressure generation units corresponding to the pigment nozzle group perform the microvibration driving immediately after the liquid holding units are replaced and while the cap is not on the liquid ejecting head.

* * * * *